United States Patent [19]

Usui

[11] 4,265,691

[45] May 5, 1981

[54] PROCESS FOR PRODUCING A MULTI-LAYERED GLASS FIBER SHEET

[76] Inventor: Fumio Usui, 441, Shimofusa, Tama-ku, Kawasaki-shi, Kanagawen-ken, Japan

[21] Appl. No.: 953,970

[22] Filed: Oct. 19, 1978

[30] Foreign Application Priority Data

Mar. 20, 1978 [JP] Japan ..... 53-31863

[51] Int. Cl.[3] ..... B31C 13/00

[52] U.S. Cl. ..... 156/172; 156/173; 156/174; 156/175

[58] Field of Search ..... 156/173, 174, 175, 172

[56] References Cited

U.S. PATENT DOCUMENTS

| | | | |
|---|---|---|---|
| 3,031,360 | 4/1962 | Currier | 156/174 |
| 3,092,533 | 6/1963 | Beckner | 156/174 |
| 3,677,854 | 7/1972 | Sager | 156/174 |
| 3,873,291 | 3/1975 | Miller | 156/174 |

*Primary Examiner*—James J. Bell

*Attorney, Agent, or Firm*—Wenderoth, Lind & Ponack

[57] ABSTRACT

A multi-layered glass fiber sheet is formed by alternately laying groups of glass fiber warps and glass fiber wefts upon one another. The basic structure of the multi-layered glass fiber sheet is produced by deforming a portion of a circulating endless belt into a cylindrical shape in a section of the path of the belt, guiding glass fiber warps in the longitudinal direction of the cylindrically deformed portion of the belt to cover the entire periphery of the cylinder of the belt, winding glass fiber wefts about the cylinder of the glass fiber warps at right angles or at angles less than right angles to the warps, applying additional glass fiber warps to the cylinder in the longitudinal direction of the cylinder to form a multi-layered cylindrical product comprising warps and wefts, and ripping or cutting the cylindrical product along a line in the longitudinal direction of the cylindrical product by a cutter to provide a multi-layered sheet.

10 Claims, 22 Drawing Figures

PROCESS FOR PRODUCING A MULTI-LAYERED GLASS FIBER SHEET

BACKGROUND OF THE INVENTION

This invention relates to a process for producing a glass fiber web sheet which is employed as the reinforcing material in the production of products such as reinforced synthetic resin tubes, sheets and rods.

A process for producing a tapered reinforced synthetic resin tube, for example, in an efficient manner is disclosed in Japanese Patent Publication No. 32306/1972 for the invention entitled "A process for producing a tapered reinforced synthetic resin tube". However, this process includes among various essential steps, the step of winding a reinforcing material about a core having a predetermined taper to form a reinforced core having a predetermined shape and one of the most suitable materials for such a purpose is a glass fiber sheet. Most of the conventional glass fiber sheets employed for such a purpose comprises glass fiber warps and glass fiber wefts knitted together in the same manner as conventional fiber fabrics. However, the knitted glass fiber sheet knitted in such a manner has the disadvantage that the fibers easily tend to get damaged at the intersecting points between the glass fiber warps and wefts because the glass fibers are bent at the intersecting points to thereby reduce the strength of the entire reinforced synthetic resin tube. As the sheet to be employed in producing a tapered reinforced synthetic resin tube, a sheet in which warps and wefts are merely laid one open another in a grid pattern without being knitted together is preferable. However, when a long non-woven web-like sheet is produced in this process, the wefts can not be easily and efficiently orientated and thus, such sheet is not suitable for continuous production and the sheet is not easily produced as having a multi-layered construction.

SUMMARY OF THE INVENTION

Therefore, the object of the present invention is to provide a process for continuously producing a reinforcing glass fiber sheet in a simple manner and at less cost and more particularly, to a process for continuously producing a multi-layered glass fiber sheet in which warps and wefts in adjacent layers are orientated in different directions.

The above and other objects and attendant advantages of the present invention will be more readily apparent to those skilled in the art from a reading of the following detailed description in conjunction with the accompanying drawings in which preferred embodiments of the invention are shown for illustration purposes only, but not for limiting the scope of the same in any way.

PREFERRED EMBODIMENTS OF THE INVENTION

Figure 5:
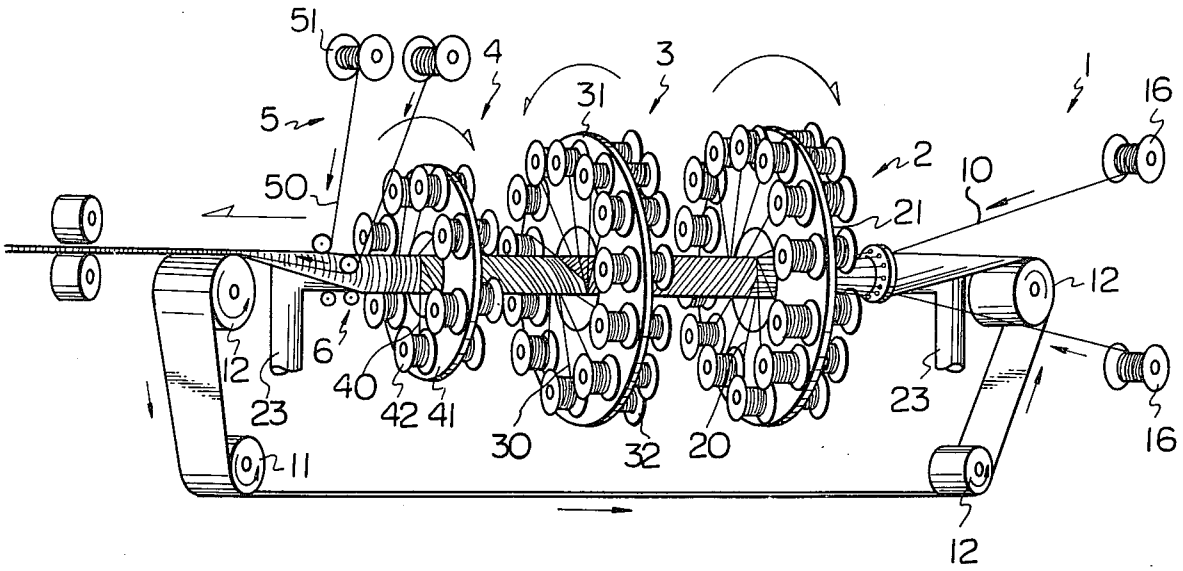

The present invention will be now described referring to the accompanying drawings. The process aspect of the present invention basically comprises the steps of paying a group of glass fiber warps in a cylindrical pattern out of a plurality of supply bobbins so as to orientate the warps in one longitudinal direction (FIG. 2), paying a group of glass fiber wefts out of a plurality of supply bobbins so as to continuously wind the wefts about the cylindrical pattern of the warps (FIG. 3), ripping or cutting the cylindrical product comprising the warps having the wefts wound thereabout along a line in the longitudinal direction of the cylindrical product so as to spread the cylindrical product into a flattened sheet (FIG. 3), and continuously feeding a second group of warps payed out of a plurality of supply bobbins to the sheet (FIG. 3). More particularly, the process aspect of the present invention is characterized in that the weft winding step is performed by feeding the wefts in a plurality of groups from a plurality of weft supply bobbins to the cylindrical pattern of warps (in the embodiment as shown in FIG. 5, three weft groups are employed) at different angles and in different orientations so as to provide a multi-layered sheet comprising fiber layers having different fiber orientations.

Figure 1:
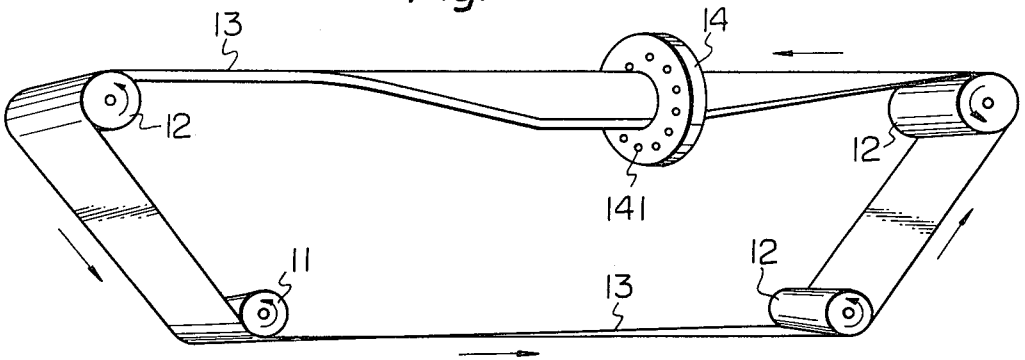
FIGS. 1 through 5 are explanatory perspective views showing the process of the present invention in successive stages thereof.
Figure 2:
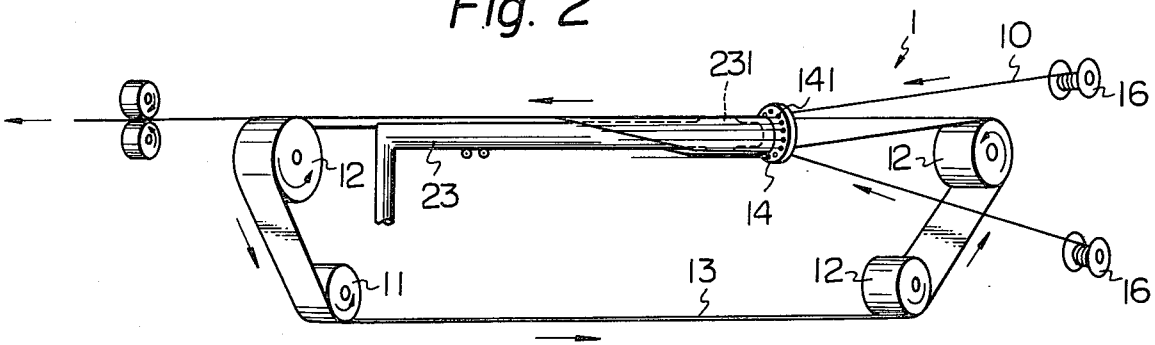
Figure 3:
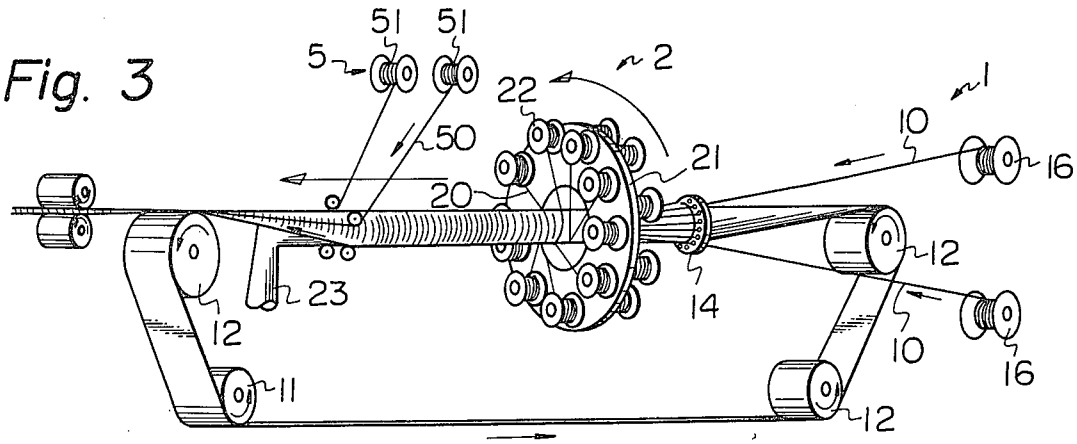

As more clearly shown in FIGS. 1 and 2, the first warp paying-out mechanism 1 is provided with an auxiliary guide means which comprises a warp paying-out and guide mechanism including a drive roller 11, a plurality of guide rollers 12 and an endless belt 13 trained about these rollers. As more clearly shown in FIG. 1, the endless belt 13 is passed in the path defined by the rollers in a substantially flat condition except for the section immediately downstream of a guide ring 14 in the path of the belt where the belt 13 is forcibly curved widthwise into a cylindrical shape. As the endless belt 13 passes through the center bore in the guide ring 14, the belt 13 is forcibly curved widthwise into a cylindrical shape having a diameter corresponding to the inner diameter of the ring 14. The endless belt may be formed of any one of the materials for conventional conveyor or power transmission belts such as leather, fabric, rubber and steel.

The annular guide 14 is provided about the belt guide bore with a plurality of circumferentially spaced warp guide through bores 141 through which the first group of warps 10 payed out of a plurality of warp supply bobbins 16 passed so that the warps 10 are advanced in the arrow direction in a cylindrical pattern after the endless belt 13 has passed through the guide ring 14 in the path defined by the rollers 11 and 12.

Figure 4:
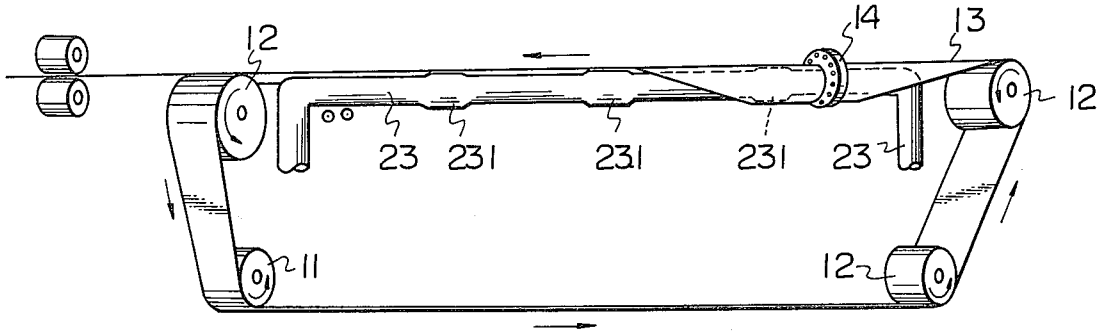

After having passed through the warp guide bores 141 in the guide ring 14, the warps 10 in the cylindrical pattern are subjected to the weft winding step in which wefts 20 are wound about the cylinder of the warps 10. As more clearly shown in FIG. 3, the weft winding mechanism 2 comprises a rotary drum 21 adapted to rotate about the axis of the cylinder of the warps 10, and the drum 21 is provided on each of the opposite sides thereof with a plurality of circumferentially spaced weft supply bobbins 22 so that as the drum 21 rotates about the axis of the cylinder of the warps 10 and accordingly, about the cylindrically deformed portion of the endless belt 13, the wefts 20 payed out of their supply bobbins 22 are wound about the warps 10 arranged in the cylindrical pattern. As shown in FIG. 4, a core 23 is provided below the upper run of the endless belt 13 and has a section positioned in coaxial alignment with the axis of the cylinder of the warps 10 about which the wefts 20 are wound. The above-mentioned section of the core 23 is provided with a plurality of enlarged diameter portions suitably spaced in the longitudinal direction of the core section to accelerate the winding of the wefts 20 about the warps 10 and also to prevent any substantial deformation of the cylinder of the warps 10.

In addition to the above-mentioned weft paying-out mechanism 2 (the mechanism will be referred to as "first weft paying-out mechanism" hereinafter), additional weft paying-out mechanisms may be provided downstream of the first weft paying-out mechanism 2 in the advancing direction of the upper run of the belt 13 as desired or necessary. As shown in FIG. 5, for example, a second weft paying-out mechanism 3 and a third weft paying-out mechanism 4 are provided in the order downstream of the first weft paying-out mechanism 2 in the advancing direction of the upper run of the belt 13. The second and third weft paying-out mechanisms 3 and 4 have substantially the same construction as the first weft paying-out mechanism, and the second and third weft paying-out mechanisms may rotate in the same direction at the same rate or in the opposite directions at different rates for winding the wefts 30 and 40 about the cylinder of the warps 10 as will be described hereinafter. For example, these weft paying-out mechanisms may be so arranged that the first rotary drum 21 is rotated in the clockwise direction (as seen in FIG. 5) at a first rate, the second rotary drum 31 is rotated in the counter-clockwise direction (as seen in FIG. 5) at the first rate and the third rotary drum 41 is rotated in the clockwise direction at a second or higher rate.

Provided in a suitable position downstream of the weft winding zone of the path in the advancing direction of the upper run of the endless belt 13 (preferably below the core 23 and in the area of the junction between the flat portion and the adjacent end of the cylindrically deformed portion of the endless belt 13) is a rotary or stationary cutter 6 which is adapted to rip or cut the cylindrical product comprising the warps 10 and wefts 20 along a line in the longitudinal direction of the cylindrical product to provide a flat multi-layered sheet. Thereafter, a second group of warps 50 are payed out of a plurality of supply bobbins 51 disposed above the cutter 6 and applied to the upper surface of the sheet in the longitudinal direction of the sheet in a laterally spaced relationship to each other to cover the upper surface of the sheet. The application of the second group of warps 50 may be carried out before or simultaneously with the cutting of the cylindrical product. Thus, the obtained sheet will have a multi-layered structure in which the weft layer or layers is sandwiched between the warp layers. The multi-layered sheet is then subjected to a bonding step in which the warps and wefts are bonded together with a suitable adhesive and taken up on a take-up reel (not shown) or directly sent to a different sheet processing line such as a reinforced synthetic resin tube production line where the sheet is used as the core of the tube thereby eliminating the reel taking-up step.

Figure 6:
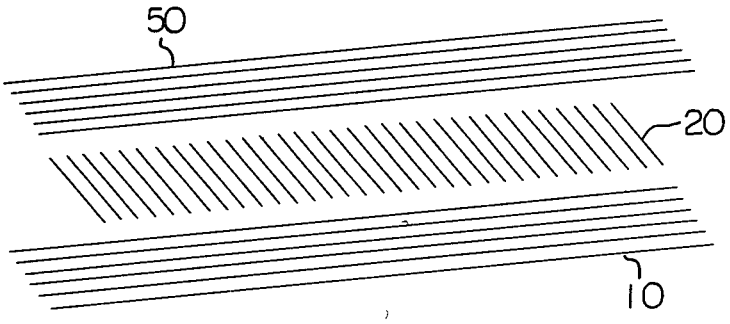
FIG. 6 is an exploded perspective view of a sheet produced by the process of the present invention.
Figure 7A:
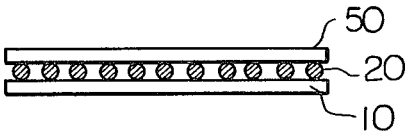
FIGS. 7A, 7B and 7C are cross-sectional views of different multi-layered sheets produced by the process of the present invention.
Figure 9A:
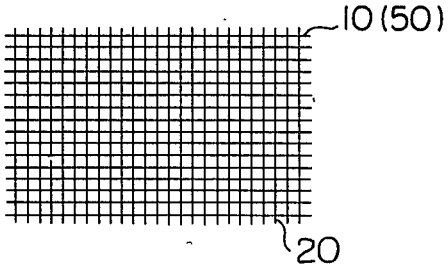
FIGS. 9A, 9B and 9C are plan views of different multi-layered sheets produced by the process of the present invention.
Figure 9B:
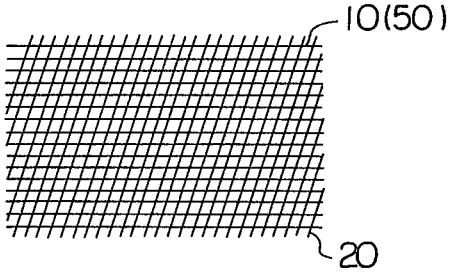

As more clearly shown in FIGS. 6 and 7A, the simplest or basic construction of the multi-layered glass fiber sheet produced by the process of the present invention comprises the layer of wefts 20 sandwiched between the lower and upper layers of warps 10 and 50 and the warps 10, 50 intersect the wefts 20 at right angles thereto as seen in plan (FIG. 9A). However, when the warps 10 and 50 are payed out at the same rate, the lower is the rotational rate of the weft paying-out drum 21, the smaller is the winding angle of the wefts 20 with respect to the warps 10, and accordingly, the intersecting pattern between the warps 10, 50 and wefts 20 is that as seen in FIG. 9B. Furthermore, when the rotating direction of the weft paying-out drum 21 is varied, the inclination direction of the wefts 20 with respect to the warps 10, 50 is reversed.

The basic construction of the multi-layered glass fiber sheet having the above-mentioned warp and weft intersection pattern can be varied in different ways as will be described hereinbelow.

First of all, the second layer of wefts 50 may be eliminated.

Figure 7B:
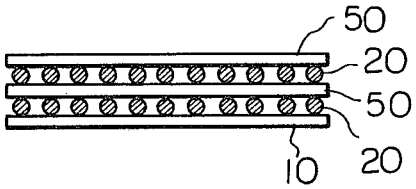
Figure 7C:
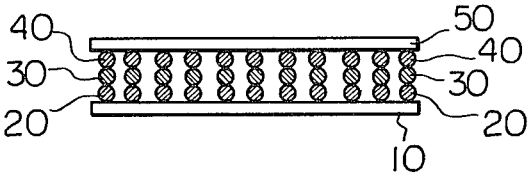

Next, an additional layer of wefts 20 and an additional layer of warps 50 may be applied in order to the basic sheet structure to obtain a modified multi-layered glass fiber sheet as seen in FIG. 7B and the upper layer of warps 50 may be eliminated and instead two additional layers of wefts 30 and 40 may be applied to the basic construction of the sheet with the second or additional layer of warps 50 eliminated therefrom to provide the multi-layered glass fiber sheet as seen in FIG. 7C.

Figures 8A, 8B, 8C:
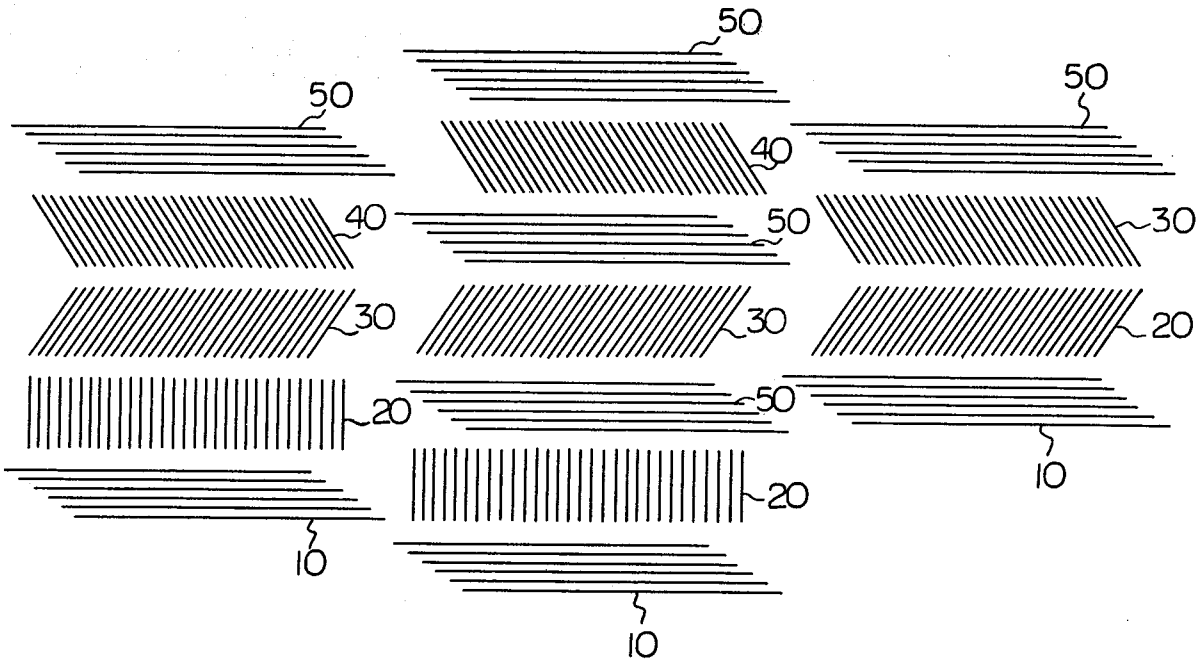
FIGS. 8A, 8B and 8C are explanatory exploded views of different multi-layered sheets showing the orientations of the fibers therein.
Figure 9C:
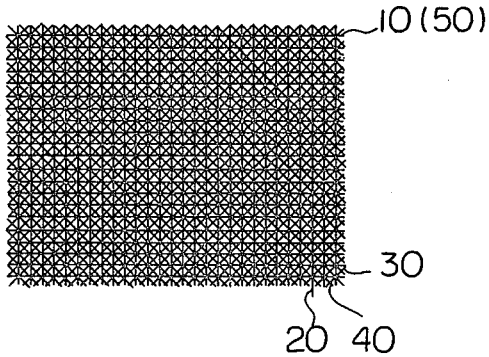

For example, when the rotating conditions of the drums are so selected that the first drum 21 is rotated in the clockwise direction at a first rate, the second drum 31 is rotated in the counter-clockwise direction at the same first rate and the third drum 41 is rotated in the clockwise direction at a second or higher rate as shown in FIG. 5, the layers of warps 10, 50 and the layers of wefts 20, 30 and 40 will be orientated as shown in FIG. 8A and have the combination of the longitudinal, transverse and slanted layers of warps and wefts as seen in the plan view of FIG. 9C.

When considering the concept described hereinabove, further applications of the concept will easily occur to those skilled in the art. Examples of such further applications are shown in FIGS. 8B and 8C. In the warp and weft layer orientation pattern as shown in FIG. 8B, the warp and weft layers are alternately laid one upon another, and in the warp and weft layer orientation pattern as shown in FIG. 8C, the two layers of wefts are sandwiched between the upper and lower layers of warps. According to the present invention, by increasing or decreasing the number of warps and wefts to be employed, the density of the multi-layered glass fiber sheet can be varied.

One embodiment of the apparatus for carrying out the process of the invention referred to hereinabove is shown in FIGS. 10 through 14. In the illustrated embodiment, only one weft paying-out mechanism 2 is provided. However, a plurality of such mechanisms may be also provided in series as mentioned hereinabove without departing from the scope of the invention. The drive mechanism 131 (FIG. 10) for driving and guiding the endless belt 13 preferably concurrently have the function to adjust the tension of the endless belt 13.

Figure 10:
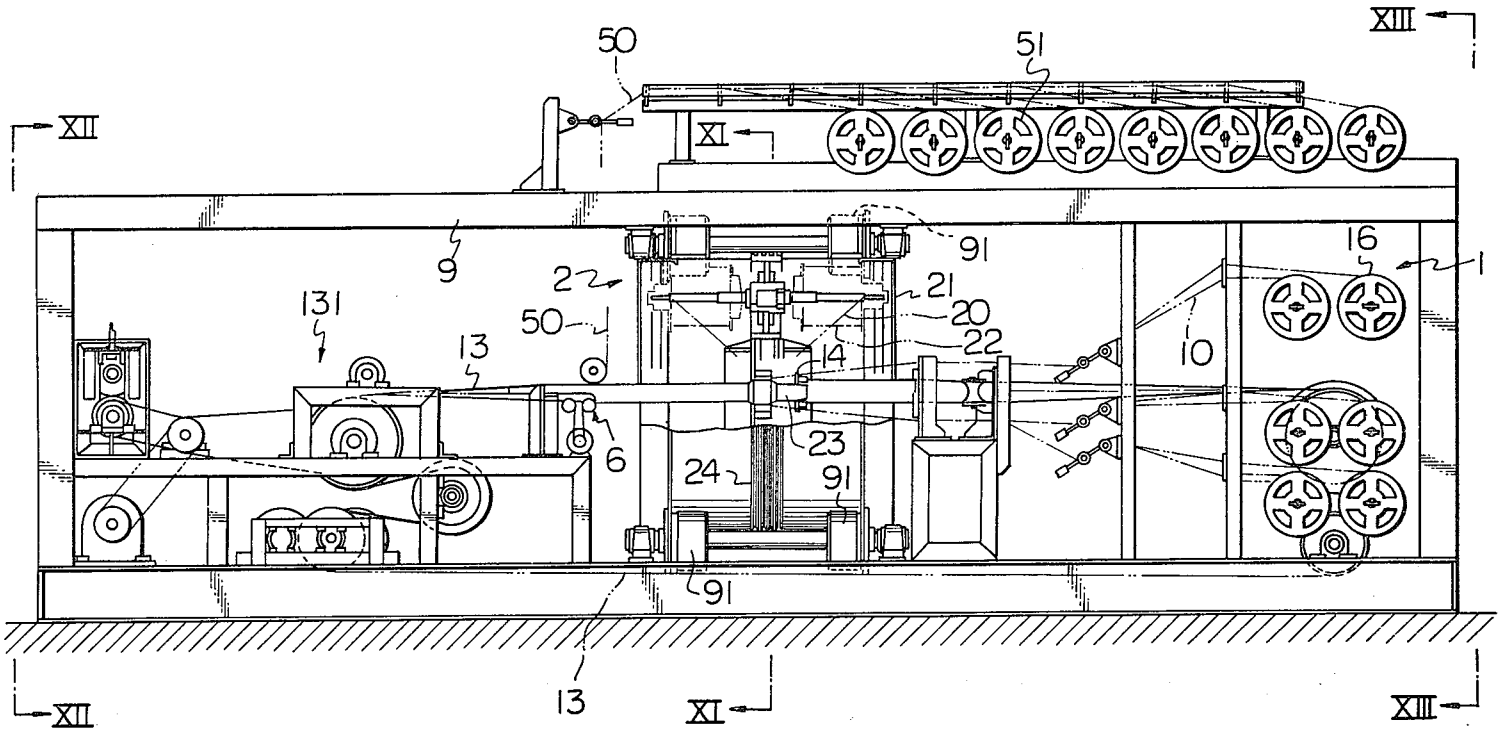
FIG. 10 is a side elevational view of one embodiment of the apparatus constructed in accordance with the principle of the present invention.
Figure 11:
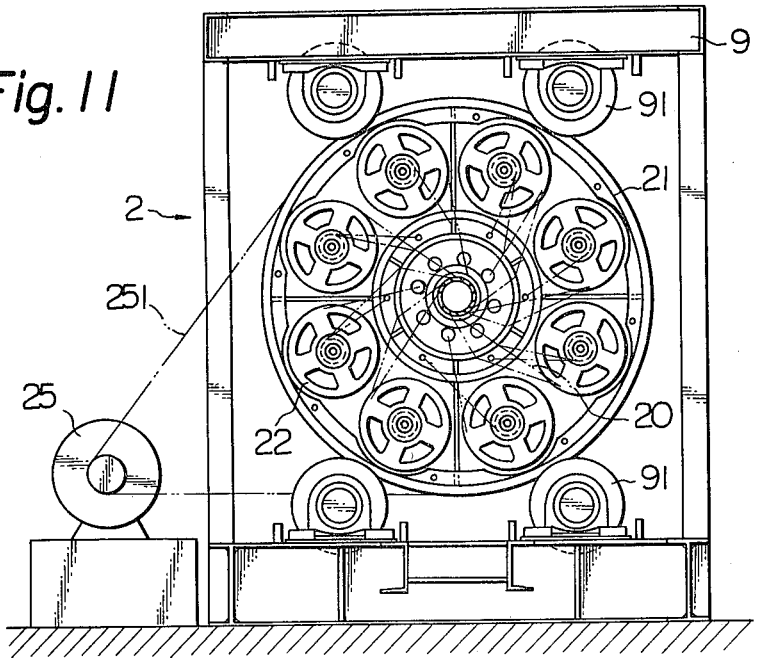
FIG. 11 is a cross-sectional view taken substantially along the line of XI—XI of FIG. 10.
Figure 12:
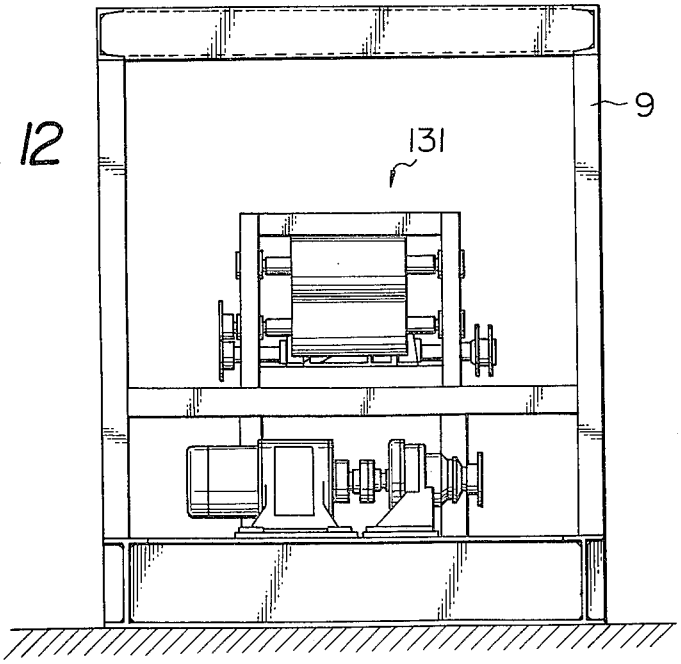
FIG. 12 is an end elevational view taken substantially along the line XII—XII of FIG. 10.
Figure 13:
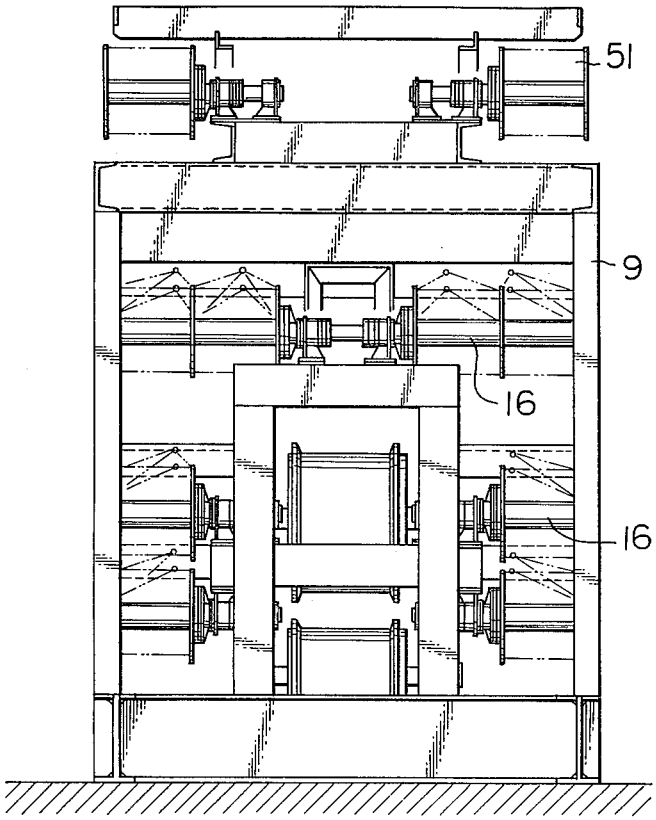
FIG. 13 is an end elevational view taken substantially along the line XIII—XIII of FIG. 10.
Figure 14:
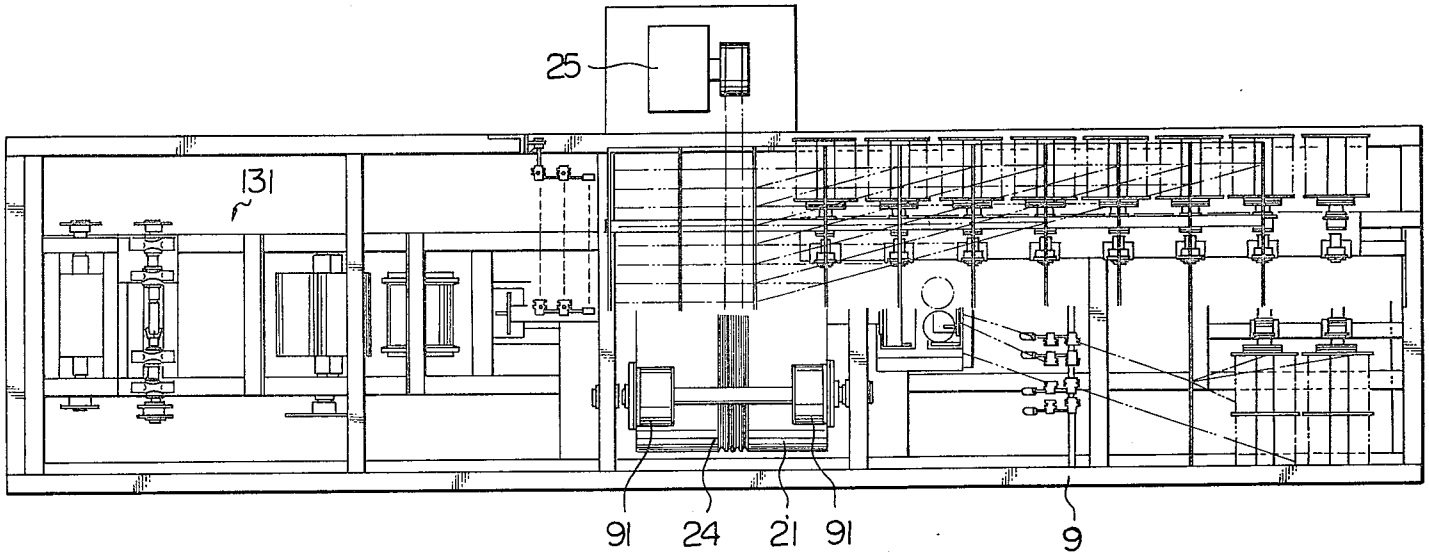
FIG. 14 is a top plan view of the apparatus shown in FIG. 10.

As more clearly shown in FIGS. 10 and 11, the drum 21 is rotatably supported at the opposite ends in support rings and held at four areas of the periphery of the drum on guide rollers 91, 91 which are in turn secured to the machine frame of the apparatus. The drum 21 has an integral V-pulley 24 which is driven from a motor 25 via a V-belt 251 to thereby wind the wefts about the cylinder of the warps.

Figure 15:
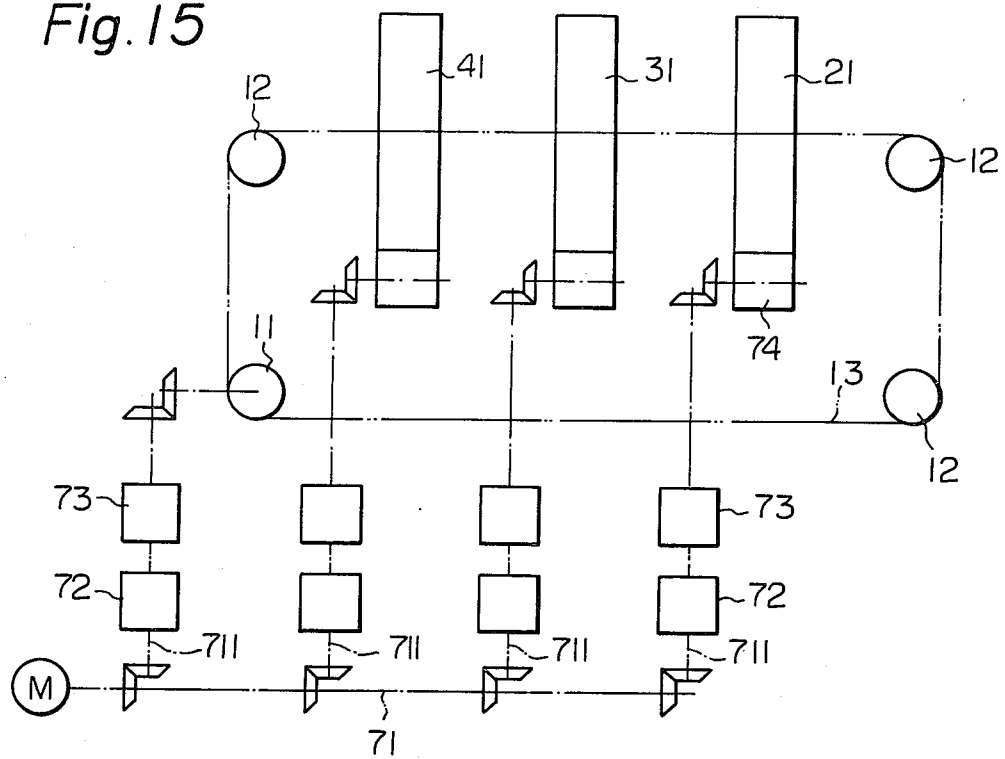
FIGS. 15 and 16 are schematic explanatory views of rotary drum drive means of the apparatus.
Figure 16:
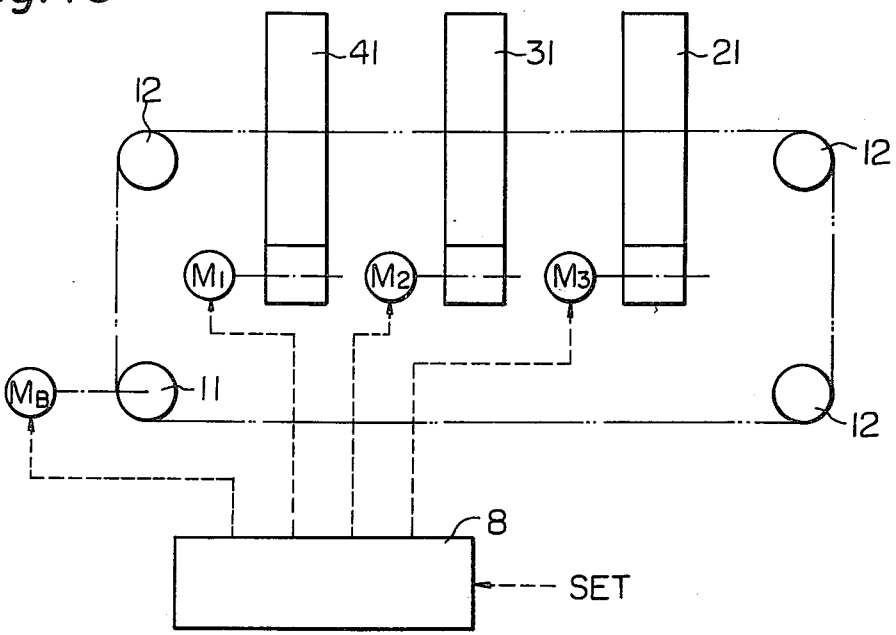

Description will be now made of the endless belt and plurality of drums. When three weft paying-out mechanisms are provided in series, for example, as more clearly shown in FIG. 15, a plurality of rotary drive shafts 711 are branched out of a common motor shaft 71 and provide for respective rotational directions and rates by respectively associated reversible monostage speed change gears 73 and clutches 72 having brakes, to thus transmit drive forces in and at set rotational directions and rates to the drive roller 11 and the rotary drive mechanisms 74 associated with the drums 21, 31 and 34, whereby the endless belt and rotary drums are mechanically driven. Alternately, as more clearly shown in FIG. 16, values for controlling rotational rate, rotational direction, operation sequence and operation timing are set in a control device 8, whereby drive commands are provided to a belt drive motor $M_b$ and motors $M_1$, $M_2$ and $M_3$ to rotate the rotary drive mechanisms 74 and in this way, the belt and drums are electrically driven. The mechanical and electrical driving systems can be selectively employed.

According to the process of the present invention, the glass fiber knitting step as conventionally necessary can be eliminated, the glass fibers are orientated in different directions, and the thus obtained multi-layered glass fiber sheet has a substantially increased mechanical strength. Also the production cost of the multi-layered glass fiber sheet is less than about 60% of that of the corresponding product formed by conventional processes.

While only several embodiments of the invention have been shown and described in detail, it will be understood that the same are for illustration purposes only and not to be taken as a definition of the invention, reference being made for this purpose to the appended claims.

I claim:

1. A process for continuously producing a multi-layered glass fiber sheet, said process comprising the steps of:

circulating a flat endless belt along a predetermined endless path;

deforming said belt, along a selected section of said path, into a cylindrical shape, thereby forming a cylindrical belt portion;

feeding a first group of glass warps longitudinally along said cylindrical belt portion in a cylindrical pattern surrounding said cylindrical belt portion, thereby forming said first group of glass warps into a cylinder having an axis extending parallel to said warps;

winding at least one group of glass wefts around said cylinder of said first group of glass warps at said cylindrical belt portion at a predetermined helical angle with respect to said cylinder;

feeding a second group of glass warps longitudinally along said cylindrical belt portion in a cylindrical pattern surrounding said cylindrical belt portion, thereby forming a cylindrical product composed of said first and second groups of glass warps and said at least one group of glass wefts; and cutting said cylindrical product along a line in the longitudinal direction of said cylindrical product, thereby providing a multi-layer glass fiber sheet.

2. A process as claimed in claim 1, comprising winding a plurality of groups of glass wefts at different predetermined helical angles.

3. A process as claimed in claim 2, comprising longitudinally feeding separate groups of glass warps in cylindrical patterns between overlapping adjacent layers of glass wefts.

4. A process as claimed in claim 1, further comprising reinforcing said cylindrical belt portion by inserting thereinto a core.

5. A process for continuously producing a multi-layered glass fiber sheet, said process comprising the steps of:

circulating a flat endless belt along a predetermined endless path;

deforming said belt, along a selected section of said path, into a cylindrical shape, thereby forming a cylindrical belt portion;

feeding a first group of glass warps longitudinally along said cylindrical belt portion in a cylindrical pattern surrounding said cylindrical belt portion, thereby forming said first group of glass warps into a cylinder having an axis extending parallel to said warps;

winding at least one group of glass wefts around said cylinder of said first group of glass warps at said cylindrical belt portion at a predetermined helical angle with respect to said cylinder, thereby forming a cylindrical product composed of said first group of glass warps and said at least one group of glass wefts;

cutting said cylindrical product along a line in the longitudinal direction of said cylindrical product, thereby providing a sheet; and feeding a second group of glass warps longitudinally onto said sheet, thereby forming a multi-layer glass fiber sheet.

6. A process as claimed in claim 5, comprising winding a plurality of groups of glass wefts at different predetermined helical angles.

7. A process as claimed in claim 6, comprising longitudinally feeding separate groups of glass warps in cylindrical patterns between overlapping adjacent layers of glass wefts.

8. A process as claimed in claim 5, further comprising reinforcing said cylindrical belt portion by inserting thereinto a core.

9. A process as claimed in any one of claims 1, 2, 5 or 6, further comprising bonding said multi-layer glass fiber sheet.

10. A process as claimed in claims 2 or 6, further comprising controlling the orientation of said wefts in said sheet by regulating the direction and speed of said winding of each of said groups of glass wefts.

* * * * *